US008401421B2

(12) United States Patent
Kawai

(10) Patent No.: US 8,401,421 B2
(45) Date of Patent: Mar. 19, 2013

(54) CHARGING DEVICE, METHOD FOR PRODUCING CHARGING DEVICE, PROCESS CARTRIDGE, AND IMAGE FORMING APPARATUS

(75) Inventor: Takeshi Kawai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 238 days.

(21) Appl. No.: 13/038,957

(22) Filed: Mar. 2, 2011

(65) Prior Publication Data

US 2012/0082475 A1 Apr. 5, 2012

(30) Foreign Application Priority Data

Sep. 30, 2010 (JP) ..... 2010-222904

(51) Int. Cl.
*G03G 15/02* (2006.01)

(52) U.S. Cl. ..... 399/100

(58) Field of Classification Search ..... 399/100, 399/111, 176, 326, 357; 492/35; 361/225
See application file for complete search history.

(56) References Cited

U.S. PATENT DOCUMENTS

| | | | | |
|---|---|---|---|---|
| 7,706,713 | B2 | 4/2010 | Terai et al. | |
| 2007/0104504 | A1 | 5/2007 | Terai et al. | |
| 2008/0025753 | A1 * | 1/2008 | Yamamoto et al. | 399/100 |
| 2011/0013928 | A1 * | 1/2011 | Kawai et al. | 399/100 |
| 2011/0158683 | A1 * | 6/2011 | Okuda et al. | 399/111 |
| 2011/0236052 | A1 * | 9/2011 | Takagi et al. | 399/100 |

FOREIGN PATENT DOCUMENTS

| | | | |
|---|---|---|---|
| JP | A-2-272594 | | 11/1990 |
| JP | A-7-219313 | | 8/1995 |
| JP | A-2001-209238 | | 8/2001 |
| JP | 2007078838 | A * | 3/2007 |
| JP | A-2007-127849 | | 5/2007 |
| JP | 2008070532 | A * | 3/2008 |
| JP | 2008145566 | A * | 6/2008 |

* cited by examiner

*Primary Examiner* — Robert Beatty
(74) *Attorney, Agent, or Firm* — Oliff & Berridge, PLC

(57) ABSTRACT

A charging device includes: a charging component, and a cleaning member for the charging component, containing a substrate and an elastic layer that contains a silicone oil and is arranged in a spiral form on an outer surface of the substrate, the charging device being satisfying a following formula:

$A \leqq 6$ atomic % wherein A is a maximum value of the contents of Si atom constituting a siloxane skeleton with respect to total atoms at a contact part where the charging component is brought into contact with the elastic layer and at a non-contact part where the charging component is not brought into contact with the elastic layer, in which the contents of Si atom are obtained by X-ray photoelectron spectroscopy of a surface of the charging component after preparing the elastic layer of the cleaning member for the charging component in an initial state and the charging component in an initial state to bring into contact with each other for 24 hours.

20 Claims, 7 Drawing Sheets

CHARGING DEVICE, METHOD FOR PRODUCING CHARGING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-222904 filed Sep. 30, 2010.

BACKGROUND

1. Technical Field

The present invention relates to a charging device, a method for producing a charging device, a process cartridge and an image forming apparatus.

2. Related Art

In an image forming apparatus using an electrophotographic process, a surface of an image carrying member formed of a photoconductor or the like is charged with a charging device to form electrostatic charge, in which an electrostatic latent image is formed with laser light or the like modulated with an image signal. Thereafter, the electrostatic latent image is visualized by developing with a charged toner, thereby forming a toner image. The toner image is then electrostatically transferred to a transfer member, such as recording paper, directly or through an intermediate transfer member, and fixed to the transfer member, thereby providing an image.

SUMMARY

According to an aspect of the invention, there is provided a charging device including:

a charging component, and a cleaning member for the charging component, containing a substrate and an elastic layer that contains a silicone oil and is arranged in a spiral form on an outer surface of the substrate, the charging device being satisfying a following formula:

$$A \leqq 6 \text{ atomic } \%$$

wherein A is a maximum value of the contents of Si atom constituting a siloxane skeleton with respect to total atoms at a contact part where the charging component is brought into contact with the elastic layer and at a non-contact part where the charging component is not brought into contact with the elastic layer, in which the contents of Si atom are obtained by X-ray photoelectron spectroscopy of a surface of the charging component after preparing the elastic layer of the cleaning member for the charging component in an initial state and the charging component in an initial state to bring into contact with each other for 24 hours.

BRIEF DESCRIPTION OF THE DRAWINGS

Exemplary embodiments of the present invention will be described in detail based on the following figures, wherein.

DETAILED DESCRIPTION

Exemplary embodiments of the invention will be described in detail below. The invention is not limited to the exemplary embodiments and may be practiced with various modifications unless the substance of the invention is impaired. The members or parts that have the same capability or function are attached with the same symbol throughout all the drawings, and the description thereof may be omitted in some cases.

Charging Device

The charging device according to an exemplary embodiment of the invention contains a charging component and a cleaning member for the charging component (a charging component cleaning member), and the charging component cleaning member contains a substrate and an elastic layer that contains a silicone oil and is arranged in a spiral form on an outer surface of the substrate. In the charging device, among the contents of Si atom constituting siloxane skeletons with respect to total atoms, which are obtained by X-ray photoelectron spectroscopy of the surface of the charging component after preparing the elastic layer of the charging component cleaning member in the initial state and the charging component in the initial state to bring into contact with each other for 24 hours, the maximum value of the content of Si atom constituting the siloxane skeleton at the contact part where the charging component is brought into contact with the elastic layer and the content of Si atom constituting the siloxane skeleton at the non-contact part where the charging component is not brought into contact with the elastic layer is 6 atomic % or less.

In the following description, the "content of Si atom constituting a siloxane skeleton with respect to total atoms" may be referred to as a "silicone concentration" in some cases. The term "silicone concentration" in the initial state means the silicone concentration from the unused state of the charging component and the charging component cleaning member to the state after printing images on 500 sheets of A-4 size recording media.

The shapes of the charging component and the charging component cleaning member according to the exemplary embodiment are not particularly limited as far as the aforementioned conditions are satisfied.

A charging roll as an example of the charging component and the charging component cleaning member according to the exemplary embodiment are described below, and the constitutional materials of the layers of the charging component and the charging component cleaning member may be applied to charging components and charging component cleaning members having other shapes.

Figure 1:
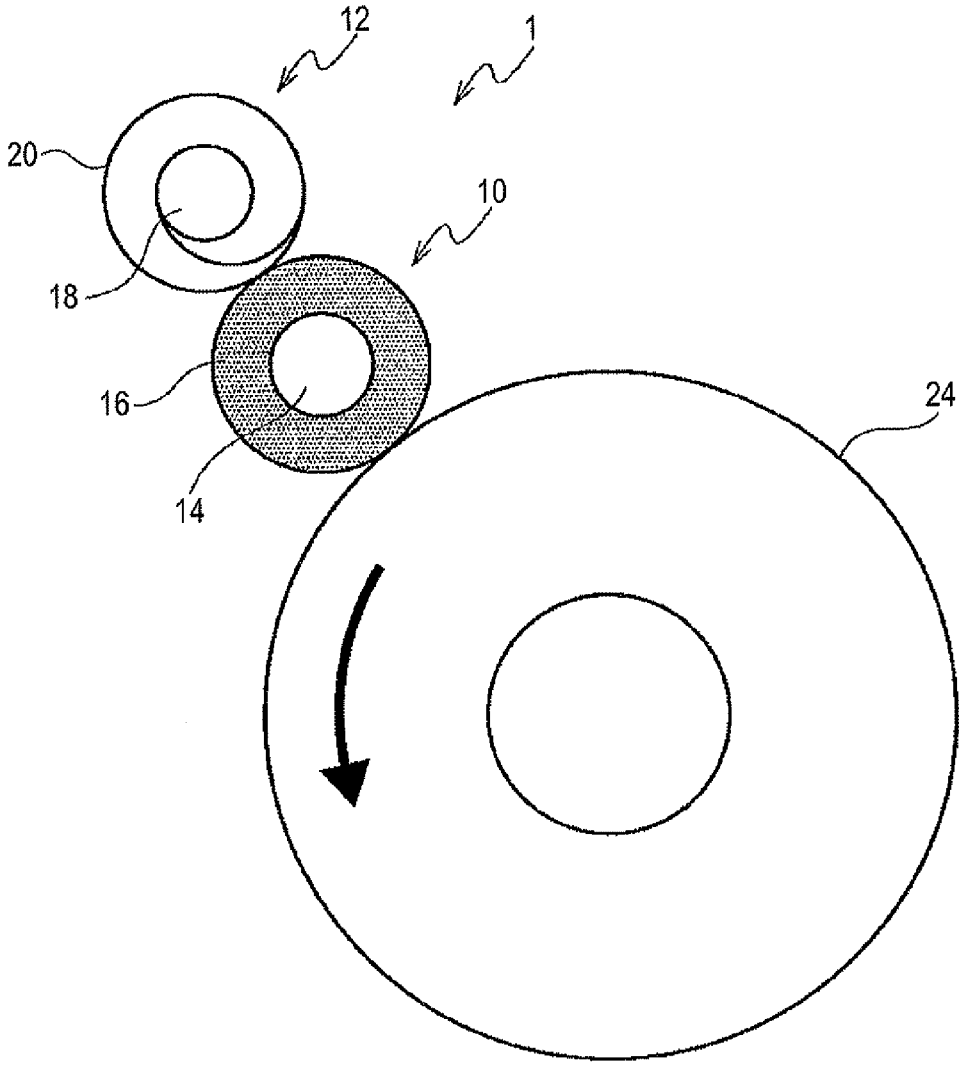
FIG. 1 is a side elevational view showing a schematic structure of an example of a charging device according to one exemplary embodiment of the invention.
Figure 2:
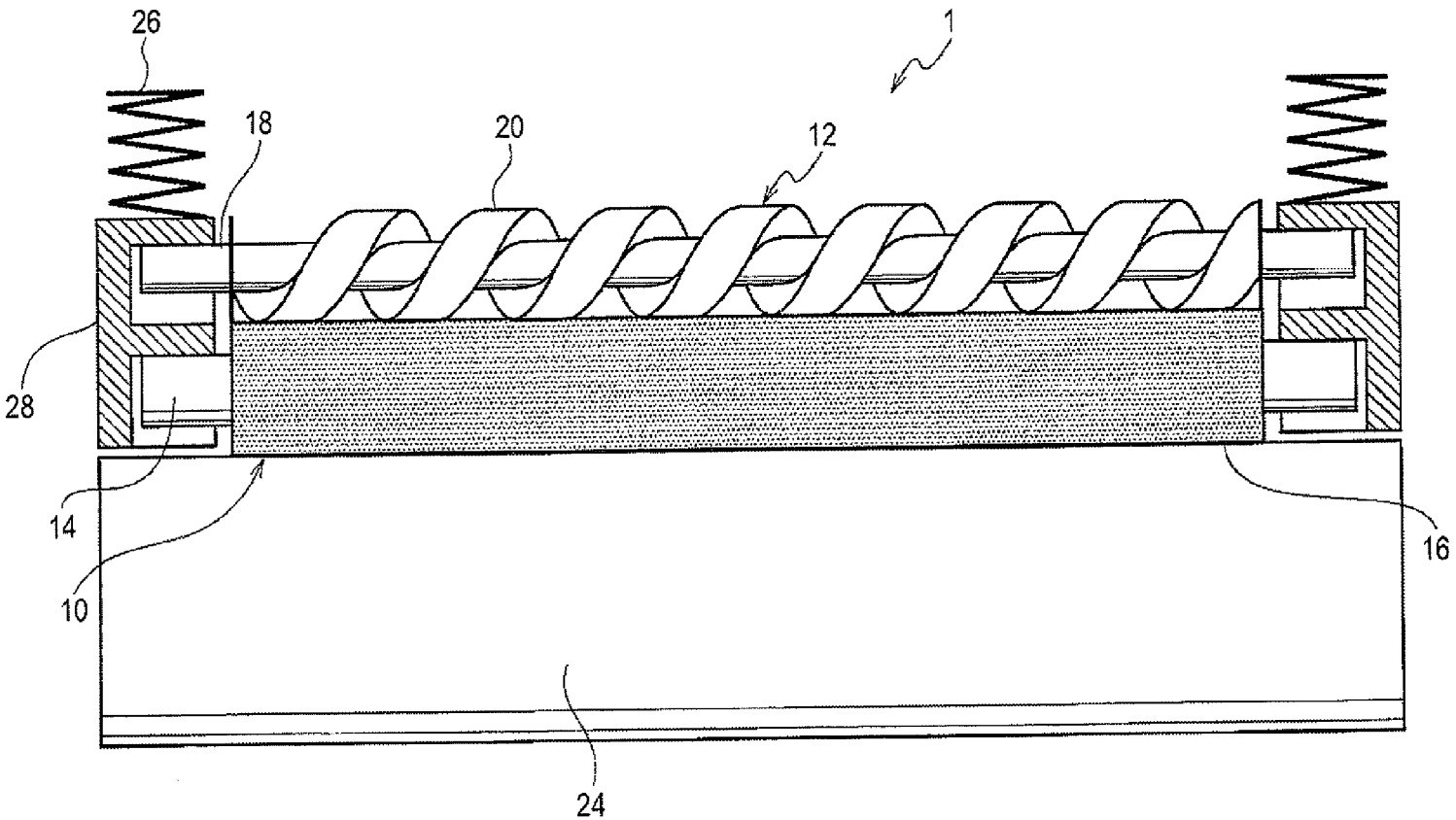
FIG. 2 is a front elevational view showing a schematic structure of an example of a charging device according to one exemplary embodiment of the invention.
Figure 3:
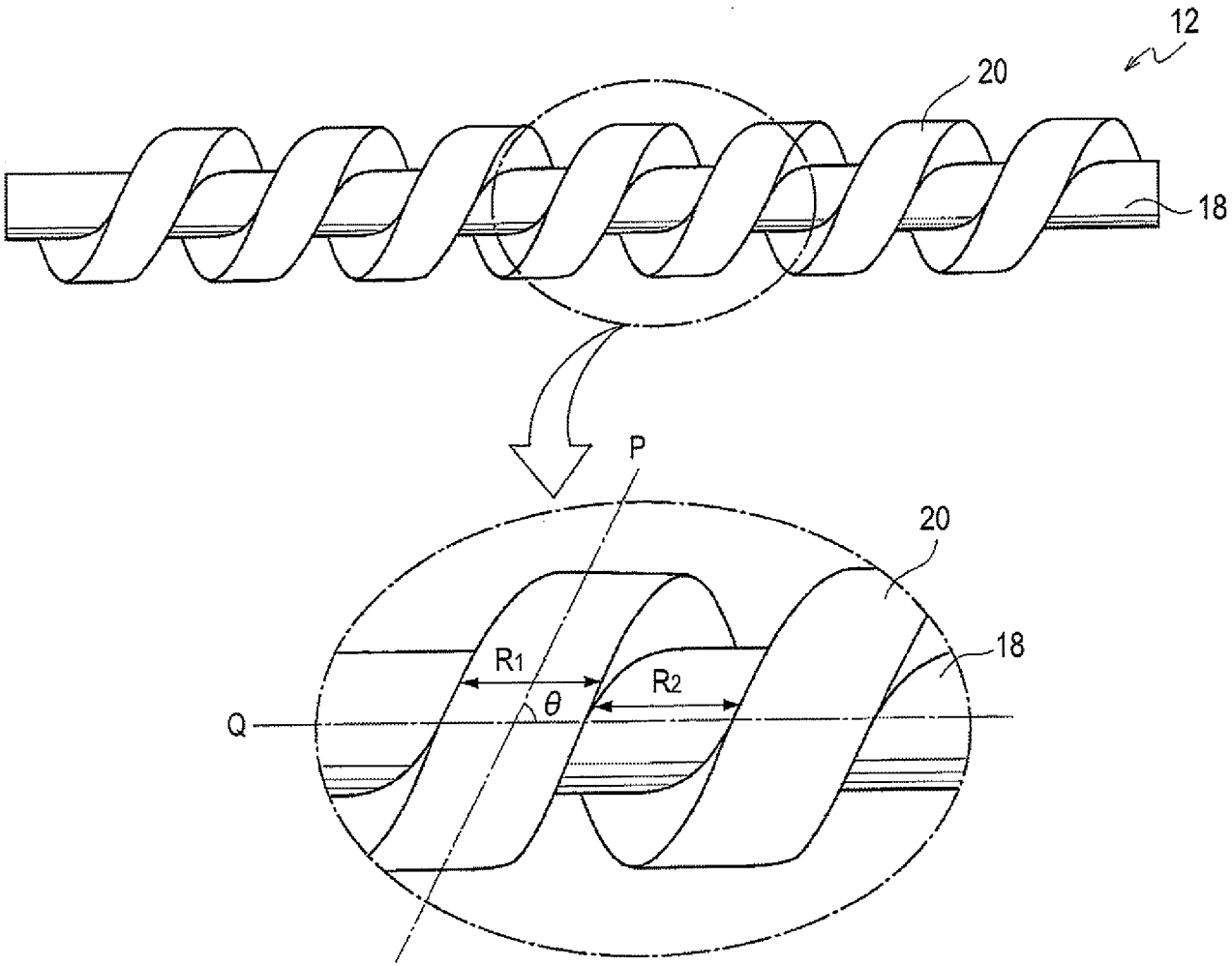
FIG. 3 is a schematic side elevational view showing an example of a charging component cleaning member used in a charging device according to one exemplary embodiment of the invention.

FIG. 1 is a side elevational view showing a schematic structure of an example of a charging device according to the exemplary embodiment. FIG. 2 is a front elevational view showing a schematic structure of an example of a charging device according to the exemplary embodiment. FIG. 3 is a schematic side elevational view showing an example of a charging component cleaning member used in a charging device according to the exemplary embodiment.

The charging device 1 shown in FIGS. 1 and 2 has a charging roll 10, which is a charging component that charges a surface of an image carrying member installed in an image forming apparatus and is a charging component in a cylindrical shape that is rotated with an axis as center, and a cleaning roll 12, which is a charging component cleaning member that is in contact with the charging roll 10 and cleans the surface of the charging roll 10.

The charging roll 10 has, for example, an electroconductive substrate 14 and a charging layer 16 formed on the outer surface of the electroconductive substrate 14. The charging layer 16 has, for example, an electroconductive elastic layer, which has on the surface thereof a surface layer or the like depending on necessity.

The cleaning roll 12 is a member in a roll form that has a substrate 18 and an elastic layer 20 formed on the outer surface of the substrate 18, and the elastic layer is arranged in a spiral form on the surface of the substrate 18, as shown in FIG. 3. Specifically, the elastic layer 20 is arranged, for example, in such a manner that the elastic layer 20 is wound in a spiral form with space over one end to the other end of the substrate 18 with the axis of the substrate 18 as the axis of the spiral.

In the charging device 1, as shown in FIG. 2, the charging roll 10 is pressed onto the surface of a photoconductor 24 as an image carrying member with an elastic member, such as coil springs 26, which are arranged on both ends of the electroconductive substrate 14, or the like, and is driven by the photoconductor 24. The cleaning roll 12 is retained with bearings 28 with the distance between the electroconductive substrate 14 of the charging roll 10 and the substrate 18 of the cleaning roll 12, and the cleaning roll 12 is made in contact with the charging roll 10 with a predetermined nip amount and is driven by the charging roll 10. The charging roll 10 and the cleaning roll 12 may be driven by the photoconductor 24 and the charging roll 10, respectively, or each may be driven independently.

The elastic layer 20 of the cleaning roll 12 arranged in a spiral form contains a silicone oil. Accordingly, when the elastic layer 20 is made in contact with the charging roll 10 as shown in FIGS. 1 and 2, the silicone oil contained in the elastic layer 20 may be transferred to the surface of the charging roll 10 in some cases. It is considered that the transfer of the silicone oil to the surface of the charging roll occurs during the use in an image forming apparatus, and continues until the silicone oil in the cleaning roll is exhausted. Therefore, it is considered that the silicone content of the cleaning roll corresponds with the silicone concentration on the charging roll, and the silicone content of the cleaning roll depends on the silicone transfer amount in the initial state.

In the charging device 1 of the exemplary embodiment, however, among the silicone concentrations, which are obtained by X-ray photoelectron spectroscopy of the surface of the charging roll 10 after making the elastic layer 20 of the cleaning roll 12 in the initial state and the charging roll 10 in the initial state into contact with each other for 24 hours, the maximum value of the silicone concentration at the contact part and the silicone concentration at the non-contact part is approximately 6 atomic % or less.

In the exemplary embodiment, the elastic layer 20 contains a silicone oil and is arranged in a spiral form, and furthermore the maximum value of the silicone concentrations after the 24-hour contact is in the aforementioned range, thereby maintaining the cleaning property of the cleaning roll 12 to the charging roll 10 (i.e., maintaining the function of the cleaning roll 12 of cleaning the surface of the charging roll 10). The mechanisms therefor are not necessarily clear but are expected as follows.

In the exemplary embodiment, the cleaning roll 12 has the elastic layer 20 arranged in a spiral form, and contamination and foreign matters on the outer surface of the charging roll 10 are removed by rubbing the outer surface with both ends in the width direction of the spiral of the elastic layer 20 (which may be hereinafter referred to as "edge parts"). Accordingly, good cleaning property of the cleaning roll 12 to the charging roll 10 is obtained, as compared, for example, to the case where a cleaning roll having an elastic layer in a cylindrical form is used.

It has been found that in the case where the cleaning roll 12 having the elastic layer 20 in a spiral form containing a silicone oil is used, the rubbing force of the edge parts to the surface of the charging roll 10 depends on the amount of the silicone oil present on the surface of the charging roll 10 (i.e., the amount of the silicone oil that is transferred from the elastic layer 20 to the surface of the charging roll 10).

Specifically, in the exemplary embodiment, the maximum value of the silicone concentrations after the 24-hour contact is in the aforementioned range. Accordingly, it is considered that the amount of the silicone oil contained in the elastic layer 20 that is transferred to the surface of the charging roll 10 (which may be hereinafter referred to as a "silicone oil transfer amount") is not too large, and the rubbing force of the edge parts to the charging roll is not lowered, thereby preventing deterioration of the cleaning function to the charging roll due to decrease of the rubbing force.

It is considered that the silicone oil transfer amount caused by the contact between the charging roll 10 and the cleaning roll 12 is decreased with the lapse of time from the start of the contact and is saturated within 24 hours. Accordingly, when the maximum value of the silicone concentrations after the 24-hour contact is in the aforementioned range, the extent of transfer of the silicone oil to the charging roll after using in an image forming apparatus can be comprehended.

In the charging device 1 according to the exemplary embodiment, the elastic layer 20 contains a silicone oil and is in a spiral form, and furthermore the maximum value of the silicone concentrations after the 24-hour contact is in the aforementioned range, thereby maintaining the cleaning property to the charging roll 10. Accordingly, image formation with an image forming apparatus that contains the charging device 1 or a process cartridge having the charging device 1 prevents occurrence of density irregularity and image defects, such as color spots, due to contamination on the surface of the charging roll 10.

The maximum value of the silicone concentrations after the 24-hour contact is 6 atomic % or approximately 6 atomic % or less, and preferably approximately 5 atomic % or less.

The silicone concentration referred herein is a value obtained in the following manner.

The elastic layer 20 of the cleaning roll 12 is brought into contact with the outer surface of the charging roll 10, and they are allowed to stand for 24 hours (temperature: 30° C., humidity: 75%). Thereafter, the charging roll 10 and the cleaning roll 12 are separated from each other, and the contact part of the outer surface of the charging roll 10 (i.e., the area that is brought into contact with the elastic layer 20) and the non-contact part thereof (i.e., the area that is not brought into contact with the elastic layer 20) are analyzed by X-ray photoelectron spectroscopy.

In the X-ray photoelectron spectroscopy, the charging layer 16 of the charging roll 10 is cut out to three pieces in 3-mm square at even intervals in parallel to the axis direction of the electroconductive substrate 14 for each of the contact part and the non-contact part, and the pieces are measured with a photoelectron spectrometer, JPS-9010MX (available from JEOL, Ltd.). The ratio (atomic %) of the number of Si atoms constituting the siloxane skeleton with respect to the total number of all the atoms constituting the surface of the charging layer 16 to be measured is obtained and is designated as the "silicone concentration". More specifically, the silicone concentration is obtained by comparing the $Si_{2p}$ peak derived from the Si atoms constituting the siloxane skeleton to the peaks derived from the other atoms constituting the surface of the charging layer 16.

The "silicone oil" referred in the exemplary embodiment is a silicone oil having an organopolysiloxane structure. Examples of compounds having the organopolysiloxane structure include a polyoxyalkylene-dimethylpolysiloxane copolymer. Specific examples of the silicone oil include those used as a silicone foam stabilizer in preparation of polyurethane or the like.

The term "initial state" referred in the exemplary embodiment means a state of from an unused state to a state after printing images on 500 sheets of A-4 size recording media with an image forming apparatus. The unused state includes a state where a charging device according to the exemplary embodiment is installed in an image forming apparatus, but image formation is not yet performed, and a state where the charging device is produced, or is stored or transported after production, but image formation is not yet performed.

In the exemplary embodiment, the term "after making into contact with 24 hours" (i.e., the 24-hour contact) means that the state where the charging layer 16 of the charging roll 10 is brought into contact with the elastic layer 20 of the cleaning roll 12 is maintained for 24 hours.

In the exemplary embodiment, in addition to the features that the cleaning roll 12 has the elastic layer 20 containing a silicone oil arranged in a spiral form, and the maximum value of the silicone concentrations after the 24-hour contact is in the aforementioned range, the surface (outer surface) of the charging roll 10 may have a 10-point average surface roughness (Rz) of from 5 μm or approximately 5 μm to 17 μm or approximately 17 μm, and the elastic layer 20 of the cleaning roll 12 may be a foamed material having an average cell diameter of from 0.1 mm or approximately 0.1 mm to 1.0 mm or approximately 1.0 mm.

The charging device 1 having the aforementioned constitution facilitates maintenance of the cleaning property to the charging roll 10.

Specifically, the mechanisms of the aforementioned constitution are considered to be as follows. When the average cell diameter is in the range, foreign matters, such as an external additive and a toner, attached to the charging roll 10 are entrained into the cells of the elastic layer 20 as a foamed material and are aggregated to form aggregates with an appropriate size. The aggregates are returned to the image carrying member through the charging roll 10 and then recovered with a cleaning member for cleaning the image carrying member. According to the operation, foreign matters are hard to be accumulated on the elastic layer 20 of the cleaning roll 12, thereby maintaining the cleaning property to the charging roll 10. When the average cell diameter is in the range, the entrainment of the foreign matters into the cell is facilitated, as compared to the case where the average cell diameter is smaller than the range, and aggregates of the foreign matters with an appropriate size are formed, and the foreign matter as the aggregates are transferred to the charging roll 10, as compared to the case where the average cell diameter is larger than the range, thereby maintaining the cleaning property.

In addition to the average cell diameter in the aforementioned range, when the 10-point average surface roughness is in the range, good cleaning property is obtained by the increased rubbing force of both the ends in the width direction of the spiral of the elastic layer 20 in a spiral form of the cleaning roll 12 to the surface of the charging roll 10, as compared to the case where the 10-point average surface roughness is smaller than the range. When the 10-point average surface roughness is in the range, transfer of the aggregates of the foreign matters aggregated in the cell of the foamed material to the surface of the charging roll 10 is facilitated, and the foreign matters are prevented from being accumulated on the elastic layer 20, thereby maintaining the cleaning property, as compared to the case where the 10-point average surface roughness is larger than the range.

The "10-point average surface roughness (Rz)" in the exemplary embodiment means a 10-point average surface roughness defined in JIS B0601 (1994). Specifically, the 10-point average surface roughness is obtained in the following manner. In a part of the profile curve having the reference length, a straight line is drawn that is in parallel to the level line and does not intersect the profile curve. Five peaks of the profile curve of from the highest peak to the fifth peak from the highest with respect to the straight line are selected, and an average value of the heights of the peaks is obtained. Five peaks of the profile curve of from the lowest peak to the fifth peak from the lowest with respect to the straight line are selected, and an average value of the heights of the peaks is obtained. The difference between the average values expressed in terms of micrometer (μm) is designated as the 10-point average surface roughness.

The 10-point average surface roughness (Rz) may be measured, for example, with a surface roughness measuring apparatus (Surfcom 1500DX, available from Tokyo Seimitsu Co., Ltd.) under conditions of a measurement length of 4 mm, a cutoff wavelength of 0.8 mm, a measurement magnification of 1,000, a measuring speed of 0.3 mm/sec and a Gaussian cutoff mode, according to the gradient correction least square curve compensation.

The 10-point average surface roughness on the surface of the charging roll 10 may be from 5 μm or approximately 5 μm to 17 μm or approximately 17 μm, preferably from approximately 6 μm to approximately 15 μm, and more preferably from approximately 8 μm to approximately 15 μm.

The "average cell diameter" in the exemplary embodiment is obtained in such a manner that the number of cells is measured per every 25 mm in length, and the cell diameter is obtained by dividing 25 mm by the number of cells, according to JIS K6400-1 (2004) Appendix 1. The average cell diameter of the elastic layer 20 may be from 0.1 mm or approximately 0.1 mm to 1.0 mm or approximately 1.0 mm, preferably from approximately 0.2 mm to approximately 0.6 mm, and more preferably from approximately 0.25 mm to approximately 0.45

Charging Component Cleaning Member

The layers constituting the charging component cleaning member, such as the cleaning roll 12, will be described. The structure of the charging component cleaning member is not particularly limited as far as the member has a function of cleaning a charging component, such as a charging roll, and has the aforementioned features, and the charging component cleaning member may have a structure that does not cause damages, contamination or the like on the surface of the charging roll, which influence the image quality.

Examples of the material used as the substrate 18 of the cleaning roll 12 in a roll form include a metal, such as free-machining steel and stainless steel, and a resin, such as polyacetal (POM). The material of the substrate 18 and the surface treating method and the like therefor may be selected depending on purposes including the sliding property. In the case where the material of the substrate 18 is a metal, the metal may be plated in view of rust prevention. In the case where the material of the substrate 18 is a material having no electroconductivity, such as a resin, the material may be used after imparting electroconductivity thereto by an ordinary process, such as plating, or may be used as it is.

The outer diameter of the substrate 18 may be, for example, in a range of from approximately 3 mm to approximately 6 mm.

The elastic layer 20 formed on the substrate 18 may have a single layer structure or a multi-layer structure including two or more layers. The elastic layer 20 may contain a foamed material or may have two layers including a solid layer and a foamed layer. The elastic layer 20 has a function of cleaning the surface of the charging component, thereby achieving the function of a cleaning roll.

Examples of the material constituting the elastic layer include a foamable resin, such as polyurethane, polyethylene, polyamide and polypropylene, and a rubber material, such as silicone rubber, fluorine rubber, urethane rubber, ethylene-propylene-diene rubber (EPDM), nitrile rubber (NBR), chloroprene rubber (CR), chlorinated polyisoprene rubber, isoprene rubber, acrylonitrile-butadiene rubber, styrene-butadiene rubber, hydrogenated polybutadiene rubber and butyl rubber, which may be used singly or as a mixture of two or more kinds of them. The material may further contain an additive, such as a foaming aid, a foam stabilizer, a catalyst, a curing agent, a plasticizer and a vulcanization accelerator, depending on necessity.

Among the aforementioned materials, the material constituting the elastic layer 20 may be a material having bubbles (i.e., a so-called foamed material) in view of capability of removing foreign matters and the like. Furthermore, foamed polyurethane may be used for preventing the surface of the charging component from being damaged due to rubbing or preventing cutoff, breakage and the like for a prolonged period of time since foamed polyurethane has resistance to rip and tension.

The polyurethane herein is not particularly limited, and examples thereof include materials obtained by reacting a polyol, such as a polyester polyol, a polyether polyol and a acrylic polyol, with an isocyanate, such as 2,4-tolylenediisocyanate, 2,6-tolylenediisocyanate, 4,4-diphenylmethanediisocyanate, tolidinediisocyanate and 1,6-hexamethylenediisocyanate. The polyurethane may contain a chain extending agent, such as 1,4-butanediol and trimethylolpropane. The polyurethane may be foamed by using a foaming agent, such as water and an azo compound, e.g., azodicarbonamide and azobisisobutyronitrile. The polyurethane may further contain an additive, such as a foaming aid, a foam stabilizer and a catalyst.

In the foamed polyurethane, polyether polyurethane using a polyether polyol as a urethane raw material (i.e., foamed polyether polyurethane) may be used since polyether polyurethane is hard to proceed hydrolysis or the like and thus has good storage stability under high temperature and high humidity condition (for example, at 45° C. and 95%), as compared to polyester polyurethane.

Examples of the foam stabilizer include a silicone foam stabilizer, such as the silicone oils mentioned above.

A silicone oil may often used as a foam stabilizer upon preparing polyether polyurethane, and thus in the case where polyether polyurethane is used as a material for the elastic layer 20, the elastic layer 20 may often contain a silicone oil.

The elastic layer 20 in the exemplary embodiment is arranged in a spiral form as shown in FIG. 3. Specifically, examples of the spiral form include one having a spiral angle θ of from 10° or approximately 10° to 65° or approximately 65° (and preferably from approximately 20° to approximately 50°) and a spiral width R1 of from 3 mm or approximately 3 mm to 25 mm or approximately 25 mm (and preferably from approximately 3 mm to approximately 10 mm). The spiral pitch R2 may be, for example, from 3 mm or approximately 3 mm to 25 mm or approximately 25 mm (and preferably from approximately 15 mm to approximately 22 mm).

The spiral angle θ means an angle (acute angle) between the longitudinal direction P of the elastic layer 20 (i.e., the spiral direction) and the axial direction Q of the substrate (i.e., the substrate axial direction).

The spiral width R1 means the length of the elastic layer 20 in the axial direction Q of the substrate 18 (i.e., the substrate axial direction).

The spiral pitch R2 means the distance between elastic layers 20 adjacent to each other in the axial direction Q of the substrate 18 (i.e., the substrate axial direction).

The elastic layer 20 is a layer constituted by a material that recovers the original shape after being deformed under application of an external force of 100 Pa.

The coverage of the elastic layer 20 (spiral width R1 of elastic layer 20)/((spiral width R1 of elastic layer 20)+(spiral pitch R2 of elastic layer)) may be from 20% to 70%, and preferably from 25% to 55%.

When the coverage of the elastic layer 20 is in the range, the charging roll 10 is prevented from re-contamination with attachments attached to the surface of the cleaning roll 12 due to prolonged period of time where the elastic layer 20 is in contact with the charging roll 10, as compared to the case where the coverage of the elastic layer 20 is larger than the range. Furthermore, the elastic layer 20 is smaller in fluctuation in thickness to provide good cleaning property to the charging roll 10, as compared to the case where the coverage of the elastic layer 20 is smaller than the range.

The thickness of the elastic layer 20 may be more than 0.5 mm and less than 4.0 mm, preferably more than 1.0 mm and less than 3.0 mm, and more preferably more than 1.5 mm and less than 2.5 mm.

The thickness of the elastic layer 20 may be constant over the spiral width direction, and the thickness Ta (mm) at the center in the spiral width direction of the elastic layer 20 may be different from the thickness Tb (mm) at both the ends in the spiral width direction of the elastic layer 20. The thickness may satisfy the following conditional expressions (A1) and (A2), preferably satisfies the following conditional expressions (B1) and (B2), and more preferably satisfies the following conditional expressions (C1) and (C2).

$$1<Tb/Ta<1.75 \quad \text{(A1)}$$

$$0.5<Ta<4.0 \quad \text{(A2)}$$

$$1.02<Tb/Ta<1.5 \quad \text{(B1)}$$

$$1.0<Ta<3.0 \quad \text{(B2)}$$

$$1.03<Tb/Ta<1.35 \quad \text{(C1)}$$

$$1.5<Ta<2.5 \quad \text{(C2)}$$

When the thickness of the elastic layer 20 satisfies the conditional expressions, the cleaning property to the charging roll 10 may be improved, as compared to the case where the thickness does not satisfy the conditional expressions. While the factors therefor are not necessarily clear, it is expected that both the ends in the spiral width direction of the elastic layer 20 protrude toward the outside of the cleaning roll 12 with respect to the center in the spiral width direction of the elastic layer 20, and the protruding parts having an appropriate elastic restoring force exert a rubbing force to the surface of the charging roll 10.

The thickness of the elastic layer 20 may be measured, for example, in the following manner.

The cleaning roll 12 fixed in the circumferential direction is scanned in the longitudinal direction of the cleaning roll 12 (i.e., the axial direction of the substrate 18) with a laser measuring apparatus (a laser scanning micrometer, model LSM6200, available from Mitutoyo Corporation) at a traverse velocity of 1 mm/s to measure the profile of the thickness of the elastic layer. Thereafter, the same measurement is performed after shifting the cleaning roll 12 in the circumferential direction, and consequently the measurement is performed at three positions with an interval of 120° in the circumferential direction. The thickness of the elastic layer 20 is calculated based on the resulting profiles.

Production Method of Charging Component Cleaning Member

The method for producing the cleaning roll 12 in the exemplary embodiment is not particularly limited, and examples of the method include a method containing: forming an elastic layer 20 that is arranged in a spiral form on an outer surface of a substrate 18, and rinsing the elastic layer 20.

The elastic layer 20 is rinsed to control the content of a silicone oil in the elastic layer 20, thereby controlling the maximum value of the silicone concentrations after the 24-hour contact.

Formation of Elastic Layer

The formation of an elastic layer may be performed, for example, by the following manners.

(1) A material (such as foamed polyurethane) for an elastic layer molded into a rectangular column shape is prepared, and a hole for inserting a substrate 18 is formed in the material with a drill or the like. A substrate 18 having an adhesive coated on the outer surface thereof is inserted into the hole of the material for an elastic layer, and the material for an elastic layer is cut into an elastic layer 20 in a spiral form, thereby providing the cleaning roll 12.

(2) A material (such as foamed polyurethane) for an elastic layer molded into a spiral form with a die is prepared, and a hole for inserting a substrate 18 is formed in the material with a drill or the like. A substrate 18 having an adhesive coated on the outer surface thereof is inserted into the hole of the material for an elastic layer, thereby providing the cleaning roll 12.

(3) A material (such as foamed polyurethane sheet) for an elastic layer in a sheet form is prepared, and a double-face adhesive tape is attached thereto. The sheet material as an elastic layer is cut into a strip form (which may be hereinafter referred simply to a strip), and the strip is wound on a substrate 18 to form the elastic layer 20, thereby providing the cleaning roll 12.

Among the methods, the method of winding the strip on the substrate 18 to form the elastic layer 20, thereby providing the cleaning roll 12, may be employed owing to the simplicity thereof.

The tension to be applied upon winding the strip on the substrate 18 may be, for example, such a tension that makes an elongation of the strip of from 0% to approximately 5%, and preferably approximately 5%, with respect to the original length of the strip.

Rinsing

The rinsing method is not particularly limited and may be performed by rinsing with a bleaching agent, a detergent, reinjected water or the like. Among these, rinsing with a bleaching agent may be employed in view of the removability of the silicone component or the like. The bleaching agent is a compound capable of decomposing coloring matters through oxidation reaction or reduction reaction of chemical substances, and examples thereof include a chlorine bleaching agent, such as sodium hypochlorite, and an oxygen bleaching agent, such as hydrogen peroxide and sodium percarbonate.

The rinsing may be performed, for example, by immersion, spraying or the like at a temperature of from 10° C. to 60° C. for a period of from 2 hours to 100 hours.

Charging Component

The charging roll 10 as the charging component will be described below, but is not limited to the structures shown below as far as it has a predetermined charging capability that is capable of charging the image carrying member as a member to be charged.

The charging roll 10 may contain, for example, an electroconductive substrate 14 and a charging layer 16 containing an elastic layer or a resin layer. The charging layer 16 may have a single layer structure containing an elastic layer or a multilayer structure containing plural layers different from each other. The charging layer 16 may be an elastic layer having been surface-treated. The term "electroconductive" herein means a volume resistivity of $1\times10^7$ Ωcm or less at 20° C., which is hereinafter the same.

Examples of the material used in the electroconductive substrate 14 include a metal, such as free-cutting steel and stainless steel, and the material and the surface-treating method therefor may be appropriately selected depending on the purposes, such as the sliding property. The electroconductive substrate 14 may be plated in view of rust prevention. When the material of the electroconductive substrate 14 does not have electroconductivity, the material may be used after imparting electroconductivity thereto by an ordinary process, such as plating.

For providing the predetermined charging capability, the elastic layer may be an electroconductive elastic layer. Examples of the electroconductive elastic layer include one containing an elastic material, such as rubber, having elasticity, an electroconductive material, such as carbon black and an ionic electroconductive agent, for controlling the resistance of the electroconductive elastic layer, and depending on necessity, additives, such as a softening agent, a plasticizer, a curing agent, a vulcanizing agent, a vulcanization accelerator, an antiaging agent, and a filler, e.g., silica and calcium carbonate. The electroconductive elastic layer may be formed, for example, by coating the mixture of the materials on the outer surface of the electroconductive substrate 14. The electroconductive elastic layer may contain, as an electroconductive agent dispersed therein for controlling the resistance, carbon black, an ionic electroconductive agent or the like to be mixed in the matrix material, and a material that perform electric conduction with at least one of electron and ion as a charge carrier. The elastic material may be a foamed material.

The elastic material constituting the electroconductive elastic layer may be formed, for example, by dispersing an electroconductive agent in a rubber material. Examples of the rubber material include isoprene rubber, chloroprene rubber, epichlorohydrin rubber, butyl rubber, urethane rubber, silicone rubber, fluorine rubber, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene-propylene-diene terpolymer rubber (EPDM), acrylonitrile-butadiene copolymer rubber, natural rubber and mixed rubber of these materials. Among these, silicone rubber, ethylene-propylene rubber, epichlorohydrin-ethylene oxide copolymer rubber, epichlorohydrin-ethylene oxide-allyl glycidyl ether copolymer rubber, acrylonitrile-butadiene copolymer rubber and mixed rubber of these materials are preferably used. The rubber material may be a foamed material or a non-foamed material.

Examples of the electroconductive agent used include an electron electroconductive agent and an ionic electroconductive agent. Examples of the electron electroconductive agent include fine powder of such materials as carbon black, such as Ketjen black and acetylene black; pyrolytic carbon; graphite; an electroconductive metal or alloy, such as aluminum, copper, nickel and stainless steel; an electroconductive metal oxide, such as tin oxide, indium oxide, titanium oxide, a tin oxide-antimony oxide solid solution and a tin oxide-indium oxide solid solution; an insulating material having a surface subjected to electroconductive treatment. Examples of the ionic electroconductive agent include a perchlorate salt, a chlorate salt or the like of tetraethylammonium, lauryltrimethylammonium or the like, and a perchlorate salt, a chlorate salt or the like of an alkali metal or an alkaline earth metal, such as lithium and magnesium.

The electroconductive agent may be used singly or as a combination of two or more kinds thereof. The amount of the electroconductive agent added is not particularly limited, and for example, may be from 1 part by mass to 60 parts by mass for the electron electroconductive agent per 100 parts by mass of the rubber material, and may be from 0.1 part by mass to 5.0 parts by mass for the ionic electroconductive agent per 100 parts by mass of the rubber material.

A surface layer may be formed on the surface of the charging roll 10 for preventing contamination with foreign matters, such as a toner. The material for the surface layer is not particularly limited and may be any of a resin, rubber and the like. Examples of the resin or rubber include polyester, polyimide, copolymer nylon, a silicone resin, an acrylic resin, polyvinylbutyral, an ethylene-tetrafluoroethylene copolymer, a melamine resin, fluorine rubber, an epoxy resin, polycarbonate, polyvinyl alcohol, cellulose, polyvinylidene chloride, polyvinyl chloride, polyethylene and an ethylene-vinyl acetate copolymer.

Among these materials, polyvinylidene fluoride, a tetrafluoroethylene copolymer, polyester, polyimide and copolymer nylon may be preferably used from the standpoint of prevention of contamination due to an external additive of a toner. The copolymer nylon contains one or plural kinds selected from nylon 6,10, nylon 11 and nylon 12 as a polymerization unit, and examples of the other polymerization unit contained in the copolymer include nylon 6 and nylon 6,6. The proportion of the polymerization unit including nylon 6,10, nylon 11, nylon 12 and the like in the copolymer may be approximately 10% by mass or more.

The resin or rubber may be used singly or as a mixture of two or more kinds thereof, and the resin and the rubber may be used as a mixture. The number average molecular weight of the resin or rubber may be, for example, from 1,000 to 100,000, and preferably from 10,000 to 50,000.

The surface layer may contain an electroconductive material for controlling the resistance. The electroconductive material contained may have a particle diameter of 3 μm or less.

Examples of the electroconductive agent for controlling the resistance include carbon black, electroconductive metal oxide particles, an ionic electroconductive agent or the like to be mixed in the matrix material, and a material that perform electric conduction with at least one of electron and ion as a charge carrier.

Specific examples of the carbon black as the electroconductive agent include carbon black having pH of 4.0 or less, such as Special Black 350, Special Black 100, Special Black 250, Special Black 5, Special Black 4, Special Black 4A, Special Black 550, Special Black 6, Color Black FW200, Color Black FW2 and Color Black FW2V, which are available from Degussa AG, and Monarch 1000, Monarch 1300, Monarch 1400, Mogul-L and Regal 400R, which are available from Cabot Speciality Chemicals, Inc.

Examples of the electroconductive metal oxide particles as the electroconductive agent for controlling the resistance include electroconductive particles of tin oxide, tin oxide doped with antimony, zinc oxide, anatase-type titanium oxide, ITO and the like, without any particular limitation as far as it is an electroconductive agent using electron as a charge carrier. These materials may be used singly or in combination of two or more kinds thereof. The particle diameter thereof is not particularly limited unless the advantages of the exemplary embodiment are reduced. From the standpoint of control of the resistance, the strength and the like, tin oxide, tin oxide doped with antimony and anatase-type titanium oxide are preferred, and tin oxide and tin oxide doped with antimony are more preferred.

The surface layer may be constituted by a fluorine or silicone resin, particularly a fluorine-modified acrylate polymer. The surface layer may contain particles. According to the constitution, the surface layer becomes hydrophobic, thereby preventing foreign matters from being attached to the charging roll 10. The charging roll may be imparted with unevenness on the surface thereof by adding insulating particles, such as alumina and silica, thereby decreasing the load on sliding with a photoconductor drum, which enhances the wear resistance of both the charging roll and the image carrying member. The term "insulating" herein means a volume resistivity of $1\times10^{13}$ Ωcm or more at 20° C., which is hereinafter the same.

The outer diameter of the charging roll 10 may be from 8 to 16 mm. The outer diameter is preferably 14 mm or less from the standpoint of miniaturization of an image forming apparatus. When the outer diameter is less than 8 mm, the number of times the outer surface of the charging roll is brought into contact with an external additive is increased, and the number of times of discharge is also increased, which may be disadvantageous in maintenance of the charging capability in some cases. The outer diameter of the charging roll may be measured with a commercially available apparatus, such as a vernier caliper or a laser outer diameter measuring apparatus.

The microhardness of the charging roll 10 may be from 46 to 60°. When the microhardness is larger than 60°, the contact with an image carrying member may be insufficient even when the charging component cleaning member is attached thereto, whereby fluctuation in image density may occur in some cases. When the hardness is smaller than 45°, the contact with an image carrying member can be ensured without the use of the charging component cleaning member. The methods for decreasing the hardness include a method of increasing the amount of a plasticizer added, and a method of using a material with low hardness, such as silicone rubber. However, the former method may cause bleed of the plasticizer, which may bring about problems, such as deterioration in image quality, and the latter method may increase the cost considerably.

The microhardness of the charging roll 10 may be measured, for example, with a hardness meter, model MD-1, available from Kobunshi Keiki Co., Ltd.

The charging roll has been described above as one example of the charging device, but the charging device is not limited to a charging device in a roll form, and charging devices in a brush form, a belt form, a blade form and the like may be used.

Process Cartridge

A process cartridge according to an exemplary embodiment of the invention contains an image carrying member and a charging device that charges the surface of the image carrying member.

The process cartridge according to the exemplary embodiment may further contain depending on necessity at least one selected from a latent image forming device that forms a latent image on the charged surface of the image carrying member, a developing device that develops the latent image formed on the surface of the image carrying member with a developer containing a toner to form a toner image, a transferring unit that transfers the toner image formed on the surface of the image carrying member to a transfer material, and an image carrying member cleaning unit that cleans the surface of the image carrying member after transferring the image.

Figure 4:
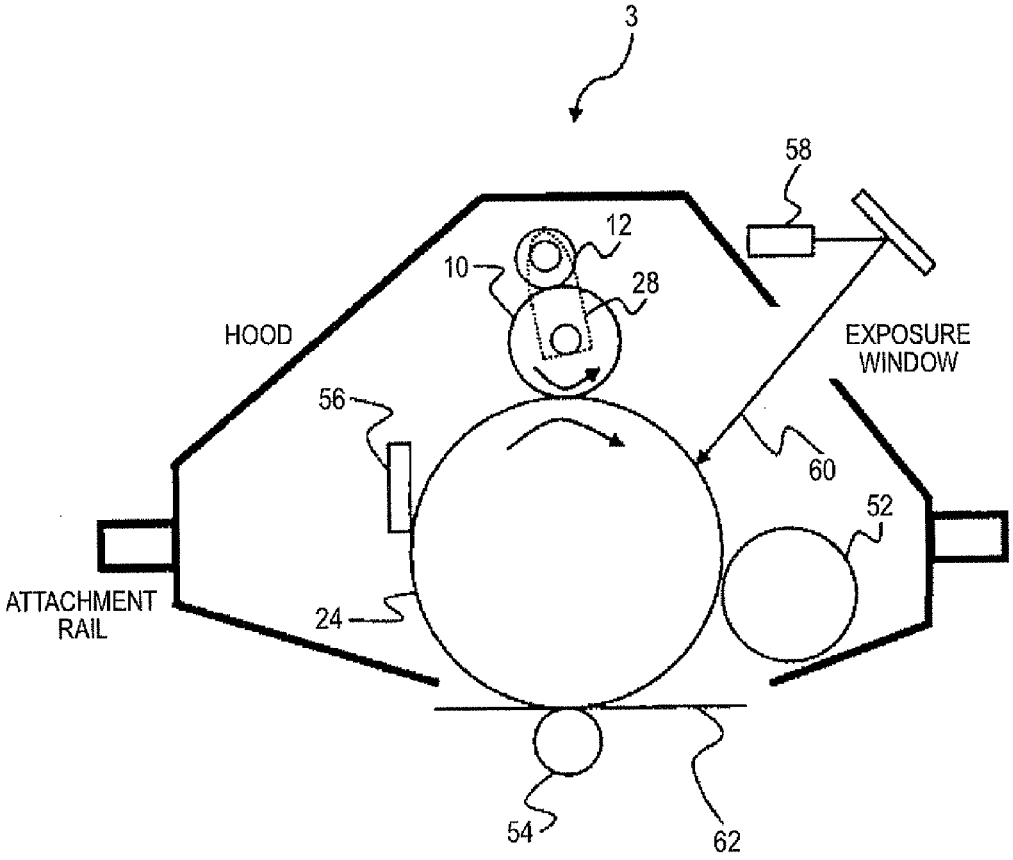
FIG. 4 is a schematic illustration showing a structure of an example of a process cartridge according to one exemplary embodiment of the invention.

A schematic structure of an example of the process cartridge according to the exemplary embodiment will be described with reference to FIG. 4.

A process cartridge 3 has a photoconductor (electrophotographic photoconductor) 24 as an image carrying member, on which an electrostatic latent image is to be formed, a charting roll 10 having a cylindrical form as a charging component that charges the surface of the photoconductor 24 through contact therewith, a cleaning roll 12 as a charging component cleaning member that cleans the surface of the charging roll 10 through contact with the charging roll 10, a developing roll 52 as a member of a developing device that forms a toner image by attaching a toner to the electrostatic latent image formed on the surface of the photoconductor 24, and a cleaning blade 56 as a member of an image carrying member cleaning device that removes the toner and the like remaining on the photoconductor 24 after transferring the toner image, through contact with the surface of the photoconductor 24, which are held integrally in the process cartridge 3, and the process cartridge 3 is detachable with respect to an image forming apparatus. A charging device constituted by the charging roll 10 and the cleaning roll 12 is the charging device according to the aforementioned exemplary embodiment.

When the process cartridge 3 is installed in an image forming apparatus, the charging roll 10, an exposing device 58 as a latent image forming device that forms an electrostatic latent image on the surface of the photoconductor 24 with laser light or light reflected from an original image, the developing roll 52, a transferring roll 54 as a member of a transferring device that transfers a toner image on the surface of the photoconductor 24 to recording paper 62 as a transfer material, and the cleaning blade 56 are arranged in this order around the photoconductor 24.

The maximum value of the silicone concentrations after the 24-hour contact on the surface of the charging roll 10 is in the range described above. In FIG. 4, other functional units that are necessary for the electrophotographic process are not disclosed.

The operation of the process cartridge 3 shown in FIG. 4 will be described.

A voltage is applied from a power supply (which is not shown in the figure) to the charging roll 10 in contact with the surface of the photoconductor 24, thereby charging the surface of the photoconductor 24. At this time, the photoconductor 24 and the charging roll 10 are rotated in the directions shown by the arrows in FIG. 4, respectively.

After charging, when the surface of the photoconductor is irradiated with light 60 corresponding to image information from the exposing device 58 (exposure), the portion irradiated with light is decreased in potential. The light 60 has an image-wise distribution of light amount corresponding to the density of the image, and thus a potential distribution corresponding to the image to be recorded, i.e., an electrostatic latent image, is formed through irradiation of the light 60 on the surface of the photoconductor 24. When the portion where the electrostatic latent image is formed passes through the developing roll 52, a toner is attached to the surface of the photoconductor 24 corresponding to the level of potential, thereby forming a toner image, i.e., visualizing the electrostatic latent image.

The recording paper 62 is fed with a positioning roll (which is not shown in the figure) to the portion where the toner image is formed, and thus the recording paper 62 is superimposed on the toner image on the surface of the photoconductor 24. The toner image is transferred to the recording paper 62 with the transferring roll 54, and then the recording paper 62 is separated from the photoconductor 24. The recording paper 62 thus separated is transported through a transporting path to a fixing unit (which is not shown in the figure) for fixing the toner image under heat and pressure, and then discharged to the output tray of the apparatus.

The charging roll 10 provided in the process cartridge 3 is equipped with the cleaning roll 12. The cleaning roll 12 and the charging roll 10 have the same polarity by applying a voltage to a bearing 28 from a power source, and foreign matters attached to the charging component, such as the toner, are removed with the cleaning blade 56 for a prolonged period of time by recovering with the cleaning blade without accumulation on the surfaces of the cleaning roll 12 and the charging roll 10. Consequently, the charging roll 10 is prevented from being contaminated for a prolonged period of time, thereby maintaining the charging property.

The photoconductor 24 has at least a function of forming an electrostatic latent image (i.e., an electrostatic charge image). The electrophotographic photoconductor has, for example, a cylindrical electroconductive substrate having on the outer surface thereof an underlayer depending on necessity, a charge generating layer containing a charge generating material, and a charge transporting layer containing a charge transporting material, which are formed in this order. The order of lamination of the charge generating layer and the charge transporting layer may be reversed. The charge generating layer and the charge transporting layer may be formed as a laminated photoconductor having a charge generating material and a charge transporting material contained in separate layers (i.e., the charge generating layer and the charge transporting layer), respectively, or may be formed as a single layer photoconductor having a charge generating material and a charge transporting material contained in the same layer, and the laminated photoconductor is preferred. An intermediate layer may be provided between the underlayer and the photoconductive layers. A protective layer may be formed on the photoconductive layers. The photoconductive layers are not limited to an organic photoconductor and may be other photoconductive layers, such as an amorphous silicon photoconductive layer.

The exposing device 58 is not particularly limited, and examples thereof include a laser optical system and an LED array, which are capable of exposing imagewise the surface of the photoconductor 24 with semiconductor laser light, LED light, liquid crystal shutter light or the like.

The developing device has a function of developing the electrostatic latent image formed on the photoconductor 24 with a one-component developer or a two-component developer containing a toner for developing an electrostatic charge image to form a toner image. The developing device is not particularly limited as far as the device has the aforementioned function, and may be selected depending on necessity from types where a toner layer is brought into contact with the photoconductor 24 or is not brought into contact therewith. Examples of the developing device include known developing devices, such as a developing device shown in FIG. 4 having a function of attaching a toner for developing an electrostatic charge image to the photoconductor 24 with the developing roll 52, and a developing device having a function of attaching the toner to the photoconductor 24 with a brush or the like.

The transferring device may have a system where a toner image is transferred directly to paper or the like, or a system where a toner image is transferred thereto through an intermediate transfer material. Examples of the system where a toner image is transferred directly to the recording paper 62 shown in FIG. 4 include a system having the transferring roll 54, which is an electroconductive or semi-electroconductive roll, and a transferring roll pressing device (which is not shown in the figure). The transferring device may have a system where a charge having the reverse polarity to the toner is applied to the recording paper 62 from the back surface of the recording paper 62 (i.e., from the opposite side to the photoconductor), thereby transferring the toner image to the recording paper 62 by the electrostatic force. The transferring roll 54 may be appropriately selected in consideration of the width of the image area to be charged, the shape of the transfer charging device, the opening width, the process speed (circumferential velocity) and the like. A single layer foamed roll may be used as the transferring roll 54 from the standpoint of reduction of cost.

The fixing unit as the fixing device is not particularly limited, and examples thereof include a fixing unit that fixes the toner image, which has been transferred to the recording paper 62, with heat, pressure, or heat and pressure.

Examples of the recording paper 62 as the transfer material, to which a toner image is transferred, include ordinary paper and an OHP sheet, which are used in a duplicator, a printer or the like employing an electrophotographic system. The transfer material may have smaller surface roughness for reducing the surface roughness of the image after fixing, and examples thereof include coated paper, which is ordinary paper coated with a resin or the like on the surface thereof, and art paper for printing.

Image Forming Apparatus

An image forming apparatus according to the exemplary embodiment has an image carrying member, the charging device according to the exemplary embodiment that charges the surface of the image carrying member, a latent image forming device that forms a latent image on the charged surface of the image carrying member, a developing device that develops the latent image formed on the surface of the image carrying member with a developer containing a toner to form a toner image, and a transferring device that transfers the toner image formed on the surface of the image carrying member to a transfer material. The image forming apparatus according to the exemplary embodiment may further contain depending on necessity at least one selected from an image carrying member cleaning device that cleans the surface of the image carrying member after transferring the toner image, and a fixing device that fixes the toner image having been transferred to the transfer material to the transfer material. The image forming apparatus according to the exemplary embodiment may contain the process cartridge described above.

Figure 5:
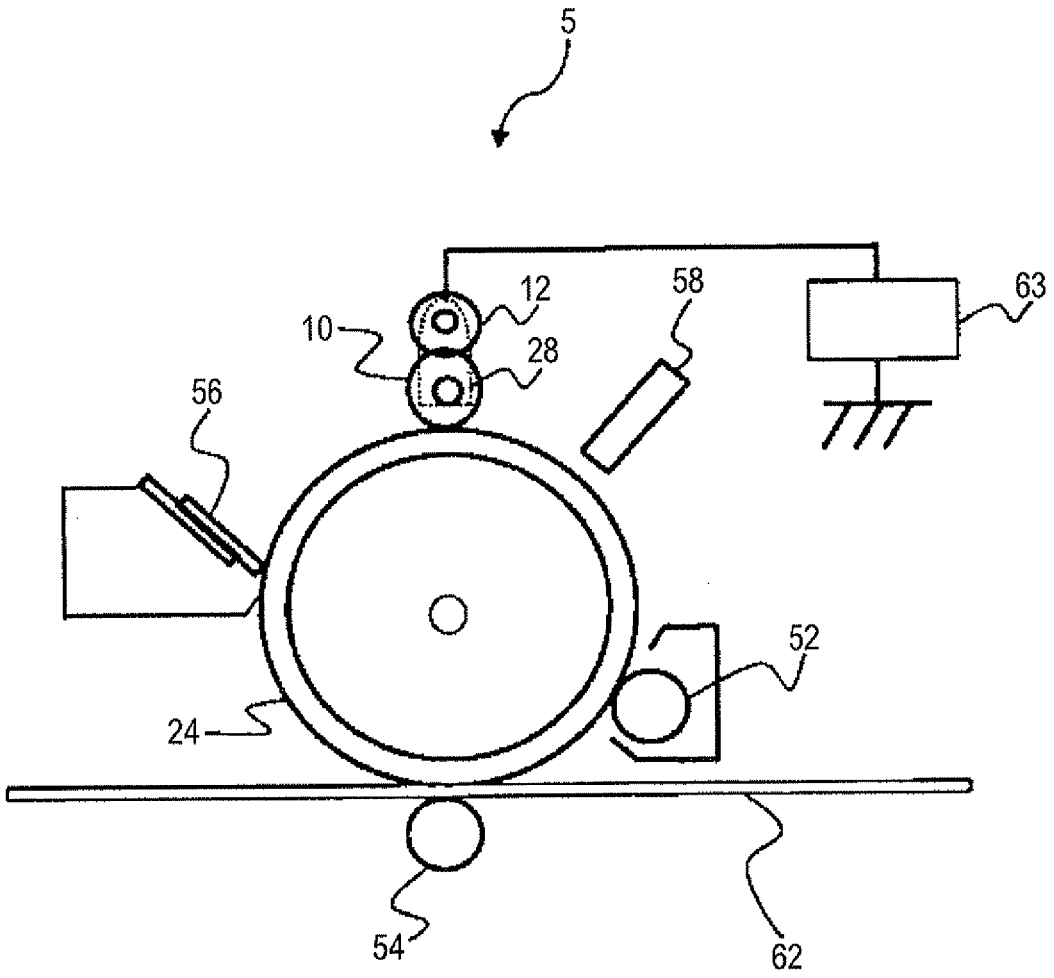
FIG. 5 is a schematic illustration showing a structure of an example of an image forming apparatus according to one exemplary embodiment of the invention.

FIG. 5 shows a schematic structure of an example of an image forming apparatus according to the exemplary embodiment, and the structure will be described below.

An image forming apparatus 5 has a photoconductor 24 as an image carrying member, on which an electrostatic latent image is to be formed, a cylindrical charging roll 10 as a charging component that charges the surface of the photoconductor 24 through contact, a cleaning roll 12 as a charging component cleaning member that cleans the surface of the charging roll 10 through contact with the charging roll 10, an exposing device 58 as a latent image forming device that forms an electrostatic latent image on the surface of the photoconductor 24 with laser light or light reflected from an original image, a developing roll 52 as a member of a developing device that forms a toner image by attaching a toner to the electrostatic latent image formed on the surface of the photoconductor 24, a transferring roll 54 as a member of a transferring device that transfers the toner image on the surface of the photoconductor 24 to recording paper 62 as a transfer material, and a cleaning blade 56 as a member of an image carrying member cleaning device that removes the toner or the like remaining on the photoconductor 24 after transferring the toner image. A charging device constituted by the charging roll 10 and the cleaning roll 12 is the charging device according to the aforementioned exemplary embodiment.

In the image forming apparatus 5, the charging roll 10, the exposing device 58, the developing roll 52, the transferring roll 54 and the cleaning blade 56 are arranged in this order around the photoconductor 24. The maximum value of the silicone concentrations after the 24-hour contact on the surface of the charging roll 10 is in the range described above. In FIG. 5, other functional units that are necessary for the electrophotographic process are not disclosed. The structures of the image forming apparatus 5 and the operation thereof upon forming an image are the same as those of the process cartridge 3 shown in FIG. 4. In FIG. 5, a power supply 63 that applies a voltage to the bearing 28 is disclosed.

Figure 6:
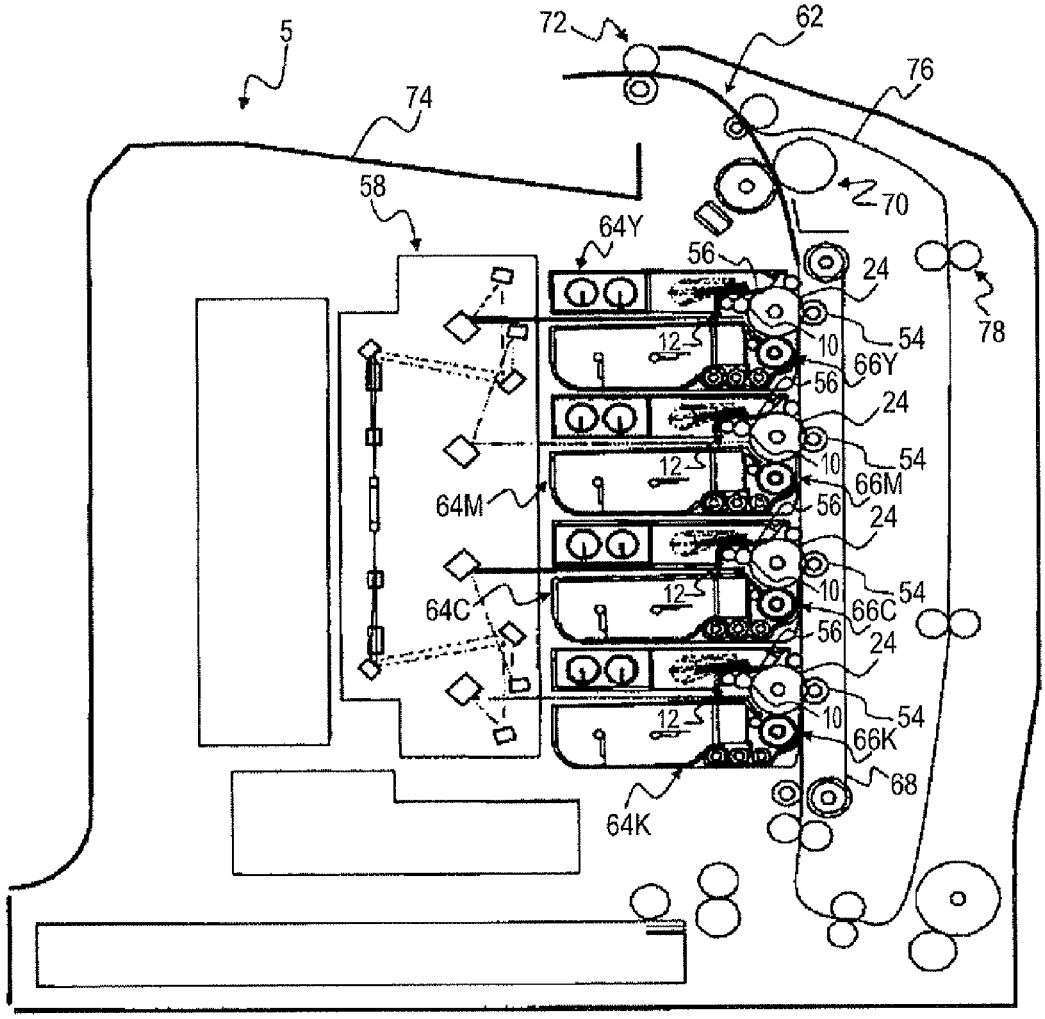
FIG. 6 is a schematic illustration showing a structure of another example of an image forming apparatus according to one exemplary embodiment of the invention.
Figure 7:
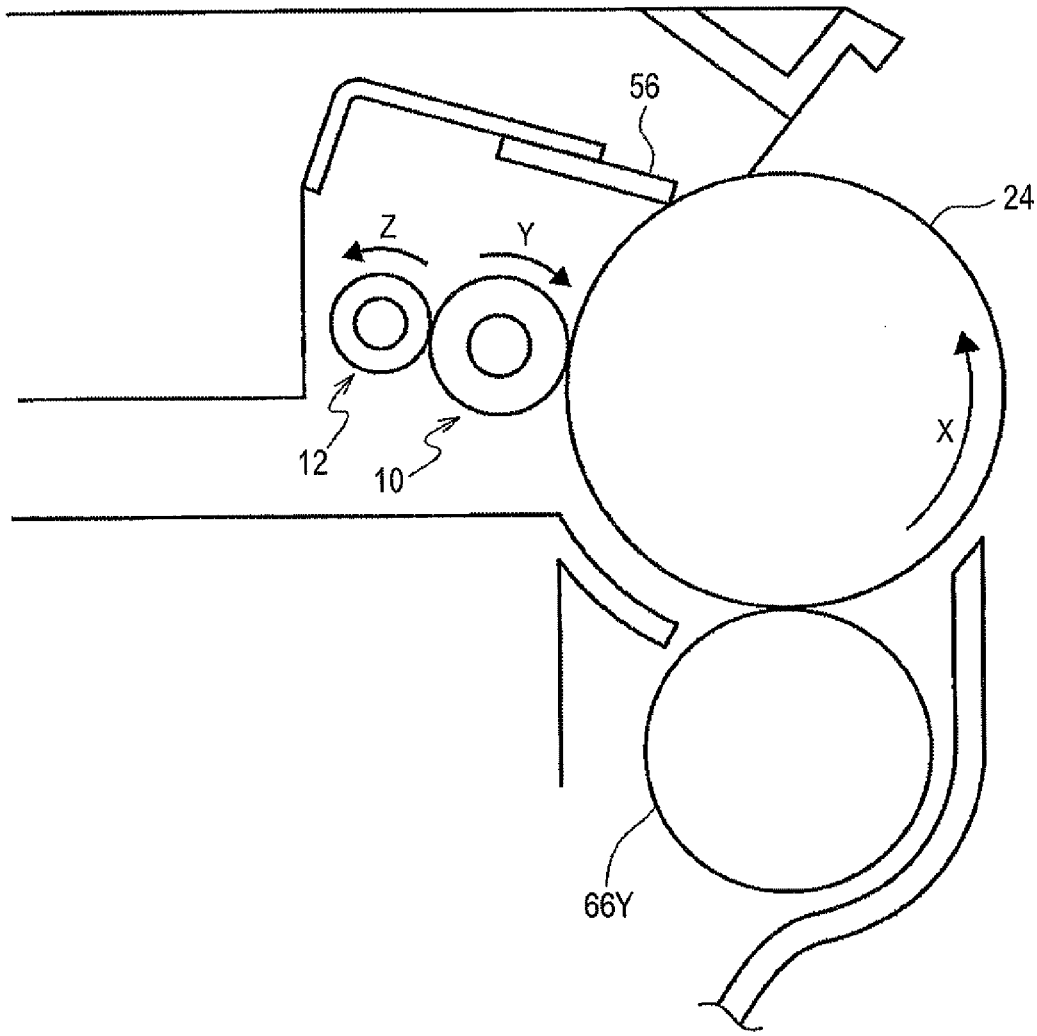
FIG. 7 is an enlarged illustration showing a charging device and the surrounding part thereof of the image forming apparatus shown in FIG.

FIG. 6 shows a color image forming apparatus 5 having a tandem system. FIG. 7 is an enlarged view of a charging device and the vicinity thereof in the image forming apparatus 5 shown in FIG. 6.

The image forming apparatus 5 shown in FIGS. 6 and 7 has, for example, a yellow cartridge 64Y containing a photoconductor (photoconductor drum) 24, a charging roll 10, a cleaning roll 12, a developing device 66Y, a cleaning blade and the like. Similarly, the image forming apparatus 5 has a magenta cartridge 64M, a cyan cartridge 64C and a black cartridge 64K having developing devices 66M, 66C and 66K, respectively, instead of the developing device 66Y in the yellow cartridge 64Y. A charging device constituted by the charging roll 10 and the cleaning roll 12 is the charging device according to the aforementioned exemplary embodiment.

The photoconductor 24 is, for example, formed of an electroconductive cylinder having a diameter of 25 mm having a photoconductor layer coated on the surface thereof, and is rotated with a motor, which is not shown in the figure, at a process speed of approximately 150 mm/sec.

The surface of the photoconductor 24 is charged to a predetermined potential with the charging roll 10, and then exposed imagewise with a laser beam or the like emitted from the exposing device 58, thereby forming an electrostatic latent image corresponding to the image information.

The electrostatic latent images formed on the photoconductors 24 are developed with the developing devices 66Y, 66M, 66C and 66K of yellow (Y), magenta (M), cyan (C) and black (K), respectively, thereby forming toner images of the predetermined colors.

In the case, for example, of forming a color image, the surfaces of the photoconductors 24 for the respective colors are subjected to the process of charge, exposure and development for the respective colors including yellow (Y), magenta (M), cyan (C) and black (K), and toner images corresponding to the respective colors including yellow (Y), magenta (M), cyan (C) and black (K) are formed on the photoconductors 24 for the respective colors.

The toner images of the respective colors including yellow (Y), magenta (M), cyan (C) and black (K) formed on the photoconductors 24 one after another are each transferred to recording paper 62 transported on the paper transporting belt 68 onto the outer surface of the photoconductors 24. The recording paper 62, to which the toner images have been transferred from the photoconductors 24, is then transported to a fixing device 70, and applied with heat and pressure with the fixing device 70, thereby fixing the toner images to the recording paper 62. Thereafter, in the case of single side printing, the recording paper 62 having the toner images fixed thereon is discharged with a discharge roll 72 to a output tray part 74 provided at the upper part of the image forming apparatus 5.

In the case of double side printing, the recording paper 62 having the toner images fixed to the first surface (front surface) with the fixing device 70 is not discharged to the output tray part 74 with the discharge roll 72, but while the back end of the recording paper 62 is held with the discharge roll 72, the discharge roll 72 is rotated reversely, and the transporting path for the recording paper 62 is switched to a transporting path 76 for double side printing. The recording paper 62 is turned over with feed rollers 78 arranged on the transporting path 76 for double side printing and then again transported with the paper transporting belt 68, thereby transferring toner images from the photoconductors 24 to the second surface (back surface) of the recording paper 62. The toner images on the second surface (back surface) of the recording paper 62 are fixed with the fixing device 70, and then the recording paper 62 is discharged to the output tray part 74.

On the surface of the photoconductor 24 after completing the transfer of a toner image, the remaining toner and paper powder are removed with the cleaning blade 56 arranged above the photoconductor 24 per one revolution, for preparing for the next image formation.

As shown in FIG. 7, around the photoconductor 24, the charging roll 10 is arranged to be in contact with the photoconductor 24. The charging roll 10 is rotatably supported. The cleaning roll 12 for cleaning the charging roll 10 is arranged to be in contact with the side of the charging roll 10 opposite to the photoconductor 24. The cleaning roll 12 is rotatably supported. On rotating the photoconductor 24 in the direction of the arrow X, for example, the charging roll 10 is rotated in the direction of the arrow Y, and the cleaning roll 12 is rotated in the direction of the arrow Z. After making the elastic layer of the unused cleaning roll 12 and the unused charging roll 10 into contact with each other for 24 hours or more, the silicone concentrations, which are obtained by X-ray photoelectron spectroscopy of the contact part and the non-contact part of the charging roll 10, are in the aforementioned range.

The charging roll 10 is pressed onto the photoconductor 24 by applying a predetermined load F to both ends of the electroconductive substrate 14, and is elastically deformed along the outer surface of the charging layer to form a contact part. The cleaning roll 12 is pressed onto the charging roll 10 by applying a predetermined load F' to both ends of the substrate 18, and the elastic layer is elastically deformed along the outer surface of the charging roll 10 to form a contact part, thereby preventing flexure of the charging roll 10 for suppressing fluctuation in contact between the charging roll 10 and the photoconductor 24 in the axial direction.

The structure of the image forming apparatus of the exemplary embodiment is not limited to the aforementioned structure, and may be a known structure of an image forming apparatus, such as an image forming apparatus of an intermediate transfer system.

EXAMPLES

The invention will be described in more detail with reference to examples below, but the invention is not limited to the examples.

Example 1

Production of Cleaning Roll

Urethane foam containing a silicone foam stabilizer produced by using a polyether polyol as a raw material (model EPM-70, available from Inoac Corporation, average cell diameter: 0.4 mm) is immersed in a bleaching agent (Haiter, available from Kao Corporation) and allowed to stand at 25° C. for 24 hours. Thereafter, the urethane foam is rinsed with ion exchanged water and processed into a sheet having a thickness of 2 mm. A double-face adhesive tape having thickness of 0.2 mm is attached to the sheet, which is then cut into a strip having a width of 6 mm and a length of 353 mm. The strip (effective length of urethane foam: 320 mm) is wound on a stepped metal shaft (outer diameter: 6 mm, total length: 337 mm, outer diameter of bearing part: 4 mm, length of bearing part: 6 mm) at a winding angle of 25° under a tension that makes an elongation of the total length of the sheet of from 0 to 5%, thereby producing an elastic layer arranged in a spiral form, and thus a cleaning roll is produced.

In the resulting cleaning roll, the elastic layer in a spiral form has a spiral angle θ of 25°, a spiral width R1 of 23.7 mm, a spiral pitch R2 of 40.4 mm, a coverage of 59%, a thickness Ta at the center in the spiral width direction of 1.75 mm, and a thickness Tb at both the ends in the spiral width direction of 2.3 mm.

Production of Charging Roll

Formation of Elastic Layer

A mixture of the following components is kneaded with an open roll and coated in a cylindrical shape having a thickness of 3 mm on a surface of an electroconductive substrate having a diameter of 6 mm formed of SUS416. The substrate having the mixture coated thereon is inserted in a cylindrical die having an inner diameter of 18.0 mm, and the mixture is vulcanized at 170° C. for 30 minutes. The substrate is taken out from the die, and the vulcanized mixture is polished to provide a cylindrical electroconductive elastic layer.

| | |
|---|---|
| Rubber material (75 parts by mass of epichlorohydrin-ethylene oxide-allyl glycidyl ether copolymer rubber, Gechron 3106, available from Nippon Zeon Corporation, and 25 parts by mass of nitrile-butadiene rubber, N250S, available from JSR Corporation) | 100 parts by mass |
| Electroconductive agent (benzyltrimethylammonium chloride, available from Kanto Kagaku Co., Ltd.) | 0.9 part by mass |
| Electroconductive agent (Ketjen black EC, available from Lion Corporation) | 15 parts by mass |
| Vulcanizing agent (sulfur, 200 mesh, available from Tsurumi Chemical Co., Ltd.) | 1 part by mass |
| Vulcanization accelerator (Nocceler DM, available from Ouchi Shinko Chemical Industrial Co., Ltd.) | 2.0 parts by mass |
| Vulcanization accelerator (Nocceler TT, available from Ouchi Shinko Chemical Industrial Co., Ltd.) | 0.5 part by mass |

Formation of Surface Layer

A dispersion solution obtained by dispersing a mixture containing the following components with a bead mill is diluted with methanol and dip-coated on the surface of the electroconductive elastic layer. The coated layer is dried by heating to 140° C. for 15 minutes to form a surface layer having a thickness of 10 μm, thereby providing a charging roll.

| | |
|---|---|
| Polymer material 1 (N-methoxymethylated nylon, F30K, available from Nagase Chemtex Corporation) | 100 parts by mass |
| Polymer material 2 (polyvinyl butyral resin, S-Lec BL-1, available from Sekisui Chemical Co., Ltd.) | 10 parts by mass |
| Electroconductive agent (carbon black, Ketjen black EC, available from Lion Corporation) | 20 parts by mass |
| Porous filler (polyamide resin particles, 2001UDNAT1, available from Arkema Co., Ltd. (Japan)) | 30 parts by mass |
| Catalyst (phosphoric acid dissociation, isopropanol/isobutanolcatalyst, Nacure 4167, available from King Industries, Inc.) | 7 parts by mass |
| Solvent (methanol) | 900 parts by mass |

The resulting charging roll has an outer surface having a 10-point average surface roughness (Rz) of 5 μm.

Example 2

Production of Charging Roll

A charging roll is produced in the same manner as in Example 1 except that the polishing condition in the production of the elastic layer is changed to make a 10-point average surface roughness (Rz) on the outer surface of the charging roll of 17 μm.

The cleaning roll used is the same as one obtained in Example 1.

Example 3

Production of Cleaning Roll

A cleaning roll is produced in the same manner as in Example 1 except that the period of time when the urethane foam is immersed in the bleaching agent is changed to 4 hours.

The charging roll used is the same as one obtained in Example 1.

Example 4

The charging roll used is the same as one obtained in Example 2, and the cleaning roll used is the same as one obtained in Example 3.

Example 5

Production of Cleaning Roll

A cleaning roll is produced in the same manner as in Example 1 except that the period of time when the urethane foam is immersed in the bleaching agent is changed to 2 hours.

The charging roll used is the same as one obtained in Example 1.

Example 6

The charging roll used is the same as one obtained in Example 2, and the cleaning roll used is the same as one obtained in Example 5.

Comparative Example 1

Production of Cleaning Roll

A cleaning roll is produced in the same manner as in Example 1 except that the urethane foam is not immersed in the bleaching agent and is not rinsed with ion exchanged water.

The charging roll used is the same as one obtained in Example 1.

Comparative Example 2

The charging roll used is the same as one obtained in Example 2, and the cleaning roll used is the same as one obtained in Comparative Example 1.

Example 7

Production of Charging Roll

A charging roll is produced in the same manner as in Example 1 except that the polishing condition in the production of the elastic layer is changed to make a 10-point average surface roughness (Rz) on the outer surface of the charging roll of 4 μm.

The cleaning roll used is the same as one obtained in Example 3.

Example 8

Production of Charging Roll

A charging roll is produced in the same manner as in Example 1 except that the polishing condition in the production of the elastic layer is changed to make a 10-point average surface roughness (Rz) on the outer surface of the charging roll of 18 μm.

The cleaning roll used is the same as one obtained in Example 3.

Comparative Example 3

Production of Cleaning Roll

A cleaning roll is produced in the same manner as in Comparative Example 1 except that urethane foam containing a silicone foam stabilizer (model RR26, available from Inoac Corporation, average cell diameter: 0.8 mm) is used as the raw material.

The charging roll used is the same as one obtained in Example 1.

Evaluation

Evaluation of Cleaning Property

A process cartridge for DocuCentre Color 400CP (available from Fuji Xerox Co., Ltd.) is modified in such a manner that a charging roll and a cleaning roll are attached thereto, and the cleaning rolls and the charging rolls produced in Examples and Comparative Examples are attached. The process cartridge is installed in DocuCentre Color 400CP (available from Fuji Xerox Co., Ltd.), and a printing test for 10,000 sheets of A4 paper (C2 Paper, available from Fuji Xerox Co., Ltd.) is performed. Thereafter, the density unevenness on image quality of a half-tone image due to cleaning unevenness of the charging roll is evaluated (evaluation of cleaning property) based on the following standard.

Evaluation Standard of Density Unevenness (Evaluation of Cleaning Property)

AA: Completely no density unevenness occurring in image quality

A: Substantially no density unevenness occurring in image quality

B: Density occurring in image quality, which is acceptable level

C: Density occurring in image quality, which is unacceptable level

The maximum value of silicone concentrations after the 24-hour contact (atomic %), the 10-point average surface roughness on the outer surface of the charging roll (μm), and the average cell diameter of the elastic layer of the cleaning roll (mm) obtained for Examples and Comparative Examples are shown in Table 1 below. The evaluation results of Examples and Comparative Examples are also shown in Table 1.

TABLE 1

| | Elastic layer of cleaning roll | | | Charging | Maximum value | |
|---|---|---|---|---|---|---|
| | Material | Rinsing (time) | Average cell diameter (mm) | roll Surface roughness (μm) | of silicone concentrations (atomic %) | Evaluation of density unevenness |
| Example 1 | EPM70 | 24 | 0.4 | 5 | 1 | AA |
| Example 2 | EPM70 | 24 | 0.4 | 17 | 1 | AA |
| Example 3 | EPM70 | 4 | 0.4 | 5 | 5 | A |
| Example 4 | EPM70 | 4 | 0.4 | 17 | 5 | A |
| Example 5 | EPM70 | 2 | 0.4 | 5 | 6 | B |
| Example 6 | EPM70 | 2 | 0.4 | 17 | 6 | B |
| Comparative Example 1 | EPM70 | 0 | 0.4 | 5 | 7 | C |
| Comparative Example 2 | EPM70 | 0 | 0.4 | 17 | 7 | C |
| Example 7 | EPM70 | 4 | 0.4 | 4 | 5 | B |
| Example 8 | EPM70 | 4 | 0.4 | 18 | 5 | B |
| Comparative Example 3 | RR26 | 0 | 0.8 | 5 | 7 | C |

It is understood from the results that in Examples, occurrence of density unevenness is suppressed, and the cleaning property to the charging roll is maintained, as compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A charging device comprising:

a charging component, and a cleaning member for the charging component, containing a substrate and an elastic layer that contains a silicone oil and is arranged in a spiral form on an outer surface of the substrate, the charging device satisfying a following formula:

$$A \leqq 6 \text{ atomic } \%$$

wherein A is a maximum value of the content of Si atom constituting a siloxane skeleton with respect to total atoms at a contact part where the charging component is brought into contact with the elastic layer and at a non-contact part where the charging component is not brought into contact with the elastic layer, in which the contents of Si atom are obtained by X-ray photoelectron spectroscopy of a surface of the charging component after preparing the elastic layer of the cleaning member for the charging component in an initial state and the charging component in an initial state to bring into contact with each other for 24 hours.

2. The charging device according to claim 1, wherein the charging device is satisfying a following formula:

$$A \leqq 5 \text{ atomic } \%.$$

3. The charging device according to claim 1, wherein the surface of the charging component has a 10-point average surface roughness (Rz) of from approximately 5 to approximately 17 μm, and the elastic layer is a foamed material having an average cell diameter of from approximately 0.1 to approximately 1.0 mm.

4. The charging device according to claim 1, wherein the elastic layer contains a foamed urethane resin.

5. The charging device according to claim 1, wherein the elastic layer contains polyether polyurethane.

6. The charging device according to claim 1, wherein the elastic layer has a spiral angle θ of from approximately 10° to approximately 65°.

7. The charging device according to claim 1, wherein the elastic layer has a spiral width of from approximately 3 mm to approximately 25 mm.

8. The charging device according to claim 1, wherein the elastic layer has a spiral pitch of from approximately 3 mm to approximately 25 mm.

9. A method for producing the charging device according to claim 1, the method comprising:

preparing a cleaning member for a charging component containing forming an elastic layer that is arranged in a spiral form on an outer surface of a core member, and rinsing the elastic layer.

10. The method for producing the charging device according to claim 9, wherein the surface of the charging component has a 10-point average surface roughness (Rz) of from approximately 5 to approximately 17 μm, and the elastic layer is a foamed material having an average cell diameter of from approximately 0.1 to approximately 1.0 mm.

11. The method for producing the charging device according to claim 9, wherein the elastic layer contains a foamed urethane resin.

12. The method for producing the charging device according to claim 9, wherein the elastic layer contains polyether polyurethane.

13. A process cartridge comprising:

an image carrying member, and the charging device according to claim 1.

14. The process cartridge according to claim 13, wherein the surface of the charging component has a 10-point average surface roughness (Rz) of from approximately 5 to approximately 17 μm, and the elastic layer is a foamed material having an average cell diameter of from approximately 0.1 to approximately 1.0 mm.

15. The process cartridge according to claim 13, wherein the elastic layer contains a foamed urethane resin.

16. The process cartridge according to claim 13, wherein the elastic layer contains polyether polyurethane.

17. An image forming apparatus comprising:

an image carrying member, the charging device according to claim 1 that charges a surface of the image carrying member, a electrostatic latent image forming device that forms a electrostatic latent image on the charged surface of the image carrying member, a developing device that develops the electrostatic latent image formed on the surface of the image carrying member, with a developer containing a toner, to form a toner image, and a transferring device that transfers the toner image formed on the surface of the image carrying member, to a transfer material.

18. The image forming apparatus according to claim 17, wherein the surface of the charging component has a 10-point average surface roughness (Rz) of from approximately 5 to approximately 17 μm, and the elastic layer is a foamed material having an average cell diameter of from approximately 0.1 to approximately 1.0 mm.

19. The image forming apparatus according to claim 17, wherein the elastic layer contains a foamed urethane resin.

20. The image forming apparatus according to claim 17, wherein the elastic layer contains polyether polyurethane.

* * * * *